US009155921B2

(12) United States Patent
Ozawa et al.

(10) Patent No.: US 9,155,921 B2
(45) Date of Patent: Oct. 13, 2015

(54) CHEMICAL PROTECTIVE SUIT

(75) Inventors: Takashi Ozawa, Saitama (JP); Kazutaka Tanino, Saitama (JP); Seiko Nitta, Tokyo (JP)

(73) Assignee: SHIGEMTSU WORKS CO., LTD., Tokyo (JP)

( * ) Notice: Subject to any disclaimer, the term of this patent is extended or adjusted under 35 U.S.C. 154(b) by 135 days.

(21) Appl. No.: 13/819,266

(22) PCT Filed: Aug. 26, 2010

(86) PCT No.: PCT/JP2010/064530

§ 371 (c)(1),
(2), (4) Date: Feb. 26, 2013

(87) PCT Pub. No.: WO2012/026030

PCT Pub. Date: Mar. 1, 2012

(65) Prior Publication Data

US 2013/0239307 A1 Sep. 19, 2013

(51) Int. Cl.

| | |
|---|---|
| ***A41D 13/00*** | (2006.01) |
| ***A62B 17/00*** | (2006.01) |
| ***A41D 13/002*** | (2006.01) |
| ***A41H 43/04*** | (2006.01) |

(52) U.S. Cl.

CPC ..... *A62B 17/006* (2013.01); *A41D 13/002* (2013.01); *A41H 43/04* (2013.01)

(58) Field of Classification Search

CPC ..... A41D 13/00; A41D 13/02
USPC ..... 2/457, 458, 456, 275, 82, 79, 69, 81, 2/242, 232, 241, 239; 156/73.4, 73.5, 156/275.1, 290, 308.4, 93
See application file for complete search history.

(56) References Cited

U.S. PATENT DOCUMENTS 2,655,663 A * 10/1953 Hoagland ..... 2/270
2,994,089 A 8/1961 Ferguson, Jr. et al.

(Continued)

FOREIGN PATENT DOCUMENTS

EP 1 120 489 A1 8/2001
JP 59-59322 U1 4/1984

(Continued)

OTHER PUBLICATIONS

International Search Report in corresponding application No. PCT/JP2010/064530, completed Sep. 9, 2010 and mailed Sep. 21, 2010.

(Continued)

*Primary Examiner* — Gloria Hale
(74) *Attorney, Agent, or Firm* — Griffin & Szipl, P.C.

(57) ABSTRACT

A chemical protective suit includes a head portion, a body portion, a pair of arm portions, a pair of leg portions, and a pair of foot portions. The aforementioned portions are integrated into a unitary body. The integrated portion of each two adjacent sheet fabric pieces in each of the foot portions comprises a seam line extending along peripheral edges of two adjacent sheet fabric pieces stacked on each other, with the peripheral edges opposed to each other, and a welded portion of the stacked sheet fabric pieces of a predetermined breadth extending along the seam line, with the peripheral edges and the welded portion disposed to face opposite sides of the seam line. The integrated portion of the two adjacent sheet fabric pieces in each of the foot portions is exposed to the external air.

6 Claims, 4 Drawing Sheets

(56) References Cited

U.S. PATENT DOCUMENTS

| | | | | | |
|---|---|---|---|---|---|
| 3,431,133 | A | * | 3/1969 | Braude et al. | 442/123 |
| 3,496,572 | A | * | 2/1970 | Benno | 2/457 |
| 3,911,913 | A | * | 10/1975 | June | 128/201.29 |
| 4,023,223 | A | * | 5/1977 | Anderson et al. | 441/104 |
| 4,272,851 | A | | 6/1981 | Goldstein | |
| 4,831,664 | A | * | 5/1989 | Suda | 2/457 |
| 4,847,914 | A | * | 7/1989 | Suda | 2/457 |
| 4,901,370 | A | * | 2/1990 | Suda | 2/457 |
| 4,920,575 | A | * | 5/1990 | Bartasis et al. | 2/457 |
| 4,924,525 | A | * | 5/1990 | Bartasis | 2/457 |
| 5,005,216 | A | * | 4/1991 | Blackburn et al. | 2/79 |
| 5,017,424 | A | | 5/1991 | Farnworth et al. | |
| 5,119,515 | A | * | 6/1992 | Altinger | 2/457 |
| 5,385,774 | A | | 1/1995 | Cramer et al. | |
| 5,885,679 | A | | 3/1999 | Yasue et al. | |
| 5,918,314 | A | * | 7/1999 | Moses | 2/79 |
| 5,960,475 | A | * | 10/1999 | Fewtrell | 2/82 |
| 6,748,609 | B1 | * | 6/2004 | Garigan | 2/457 |
| 7,328,459 | B2 | * | 2/2008 | Walsh et al. | 2/23 |
| 7,448,093 | B1 | * | 11/2008 | Ruck | 2/457 |
| 7,770,235 | B2 | * | 8/2010 | Lepage et al. | 2/82 |
| 8,028,351 | B2 | * | 10/2011 | Stachler et al. | 2/457 |
| 2009/0255039 | A1 | | 10/2009 | Danielsson | |
| 2010/0071115 | A1 | | 3/2010 | Sadato | |
| 2013/0153131 | A1 | * | 6/2013 | Ozawa et al. | 156/227 |
| 2013/0239301 | A1 | * | 9/2013 | Broderick | 2/410 |

FOREIGN PATENT DOCUMENTS

| | | | |
|---|---|---|---|
| JP | 02-229276 | A | 9/1990 |
| JP | 09-000651 | | 1/1997 |
| JP | 09-000651 | A | 1/1997 |
| JP | 2004-208824 | | 7/2004 |
| JP | 2005-200778 | | 7/2005 |
| JP | 2006-249602 | A | 9/2006 |
| JP | 2008-212162 | A | 9/2008 |
| WO | 03/037443 | A1 | 5/2003 |

OTHER PUBLICATIONS

Microfilm of the specification and drawings annexed to the request of Japanese Utility Model Application No. 155641/1982 (Laid-open No. 059322/1984), Apr. 18, 1984 (see also Foreign Reference No. 1).

Microfilm of the specification and drawings annexed to the request of Japanese Utility Model Application No. 001364/1974 (Laid-open No. 095107/1975), Aug. 9, 1975.

Written Opinion of the International Searching Authority in corresponding application PCT/JP2010/064530, completed Sep. 9, 2010 and mailed Sep. 21, 2010.

Office Action issued in co-pending related Japanese Application 2010-190086 on Sep. 18, 2013.

Office Action issued in co-pending related U.S. Appl. No. 13/819,210 on May 29, 2014.

Supplementary European Search Report issued in co-pending related application 10 85 6433 on Jul. 14, 2015.

* cited by examiner

CHEMICAL PROTECTIVE SUIT

This is a National Phase Application in the United States of International Patent Application No. PCT/JP2010/064530 filed Aug. 26, 2010, the entire disclosure of which is hereby incorporated by reference.

TECHNICAL FIELD

The present invention relates to a chemical protective suit

BACKGROUND ART

A chemical protective suit is in use that comprises a head portion for covering the part of a human body extending from the top of the head to the neck, a body portion for covering the part of a human body extending from the chest to the abdomen, a pair of arm portions for covering the parts of a human body extending from the shoulders to the wrists, a pair of leg portions for covering the parts of a human body extending from the abdomen to the calves, and a pair of foot portions for covering the parts of a human body extending from the calves to the toes. The aforementioned portions are integrated into a unitary body by integrating a plurality of sheet fabric pieces.

A pair of gloves for covering the portions of a human body extending from the wrists to the fingers are connected to the chemical protective suit beforehand. Thus, the human body is shut off from the environment when the chemical protective suit is fitted on the human body.

DISCLOSURE OF INVENTION

Problem to be Solved

The integrated portion of a pair of sheet fabric pieces adjacent to each other in each of the foot portions of a chemical protective suit conventionally comprises a seam line extending along peripheral edges of two adjacent sheet fabric pieces stacked on each other, with the peripheral edges opposed to each other, a folded portion of one of the sheet fabric pieces formed by folding the said sheet fabric piece toward the seam line at a folding line close to the seam line, with the peripheral edges and the folding line disposed to face the opposite sides of the seam line, and a seal tape stuck on the folded portion of one of the sheet fabric pieces close to the folding line, the folding line and a portion of the other of the pair of sheet fabric pieces close to the folding line. The seam line is exposed to internal air of the foot portion.

The conventional integrated portion of a pair of sheet fabric pieces adjacent to each other in each of the foot portions of a chemical protective suit has problems in that the integrated portion is not easy to produce because the process of folding one of the sheet fabric pieces and the process of sticking the seal tape on the sheet fabric pieces must be carried out, and in that the seam line and the peripheral edges of the pair of sheet fabric pieces stacked on each other, which are forming a part of the integrated portion, are exposed to the internal air of the foot portion so as to form projections in the internal space of the foot portion, toes of the wearer contact the projections and make the foot portion uncomfortable to wear.

Therefore, an object of the present invention is to provide a chemical protective suit easier to produce and more comfortable to wear than a conventional chemical protective suit.

Means for Achieving the Object

In accordance with the present invention, there is provided a chemical protective suit comprising a head portion for covering the part of a human body extending from the top of the head to the neck, a body portion for covering the part of a human body extending from the chest to the abdomen, a pair of arm portions for covering the parts of a human body extending from the shoulders to the wrists, a pair of leg portions for covering the parts of a human body extending from the abdomen to the calves, and a pair of foot portions for covering the parts of a human body extending from the calves to the toes, wherein the aforementioned portions are integrated into a unitary body by integrating a plurality of sheet fabric pieces, and wherein the integrated portion of each pair of adjacent sheet fabric pieces in each of the foot portions comprises a seam line extending along peripheral edges of two adjacent sheet fabric pieces stacked on each other, with the peripheral edges opposed to each other, and a welded portion of the stacked sheet fabric pieces of a predetermined breadth extending along the seam line, with the peripheral edges and the welded portion disposed to face opposite sides of the seam line, and wherein the integrated portion of the two adjacent sheet fabric pieces in each of the foot portions is exposed to the external air.

When the integrated portion of the two adjacent sheet fabric pieces forming the foot portion has the aforementioned structure, air tightness and chemical permeability resistance of the integrated portion is reliably secured.

In the chemical protective suit of the present invention, the integrated portion of the two adjacent sheet fabric pieces forming the foot portion does not have a folded portion of the sheet fabric piece. Therefore, the foot portion of the chemical protective suit of the present invention is easier to produce than that of the conventional chemical protective suit. In the chemical protective suit of the present invention, the integrated portion of the two adjacent sheet fabric pieces forming the foot portion is exposed to the external air outside the foot portion and does not project into the internal space of the foot portion. Therefore, the foot portion of the chemical protective suit of the present invention is more comfortable to wear than that of the conventional chemical protective suit. A boot is fitted on the foot portion. Therefore, the integrated portion of the two adjacent sheet fabric pieces exposed to the external air outside the foot portion is concealed from the eyes of others so as not to degrade the appearance of the chemical protective suit worse during use.

In accordance with a preferred aspect of the present invention, each of the sheet fabric pieces forming the foot portions is a multi-layer sheet fabric piece comprising a front surface layer of thermoplastic resin film, a rear surface layer of thermoplastic resin film, and at least one middle layer of chemical permeability resistant resin film, and wherein the welded portion is formed using high frequency dielectric heating.

When each of the sheet fabric pieces forming the foot portions is a multi-layer sheet fabric piece comprising a front surface layer of thermoplastic resin film, a rear surface layer of thermoplastic resin film, and at least one middle layer of chemical permeability resistant resin film, the sheet fabric pieces stacked on each other can be welded and integrated by high frequency dielectric heating.

In accordance with a preferred aspect of the present invention, the thermoplastic resin film forming the front surface layer and the rear surface layer of the sheet fabric piece is polyurethane resin film.

In accordance with a preferred aspect of the present invention, the thermoplastic resin film forming the front surface layer and the rear surface layer of the sheet fabric piece is polyvinyl chloride resin film.

The polyurethane resin film or the polyvinyl chloride resin film is suitably welded by high frequency dielectric heating.

In accordance with a preferred aspect of the present invention, each of the multi-layer sheet fabric pieces further comprises a middle layer of lattice fabric.

The sheet fabric piece for use in the foot portion of a chemical protective suit is desirably provided with a middle layer of lattice fabric so as to protect the middle layer of chemical permeability resistant resin film.

In accordance with a preferred aspect of the present invention, the leg portions comprise flaps for annularly covering the top outer circumferences of boots fitted on the foot portions.

When flaps are provided on the leg portions, it becomes possible to prevent chemical matters rebounding from the floor, or flowing down along the upper portion of the chemical protective suit from entering into the spaces between the boots and the foot portions.

BEST MODES FOR CARRYING OUT THE INVENTION

A chemical protective suit in accordance with a preferred embodiment of the present invention will be described.

Figure 1:
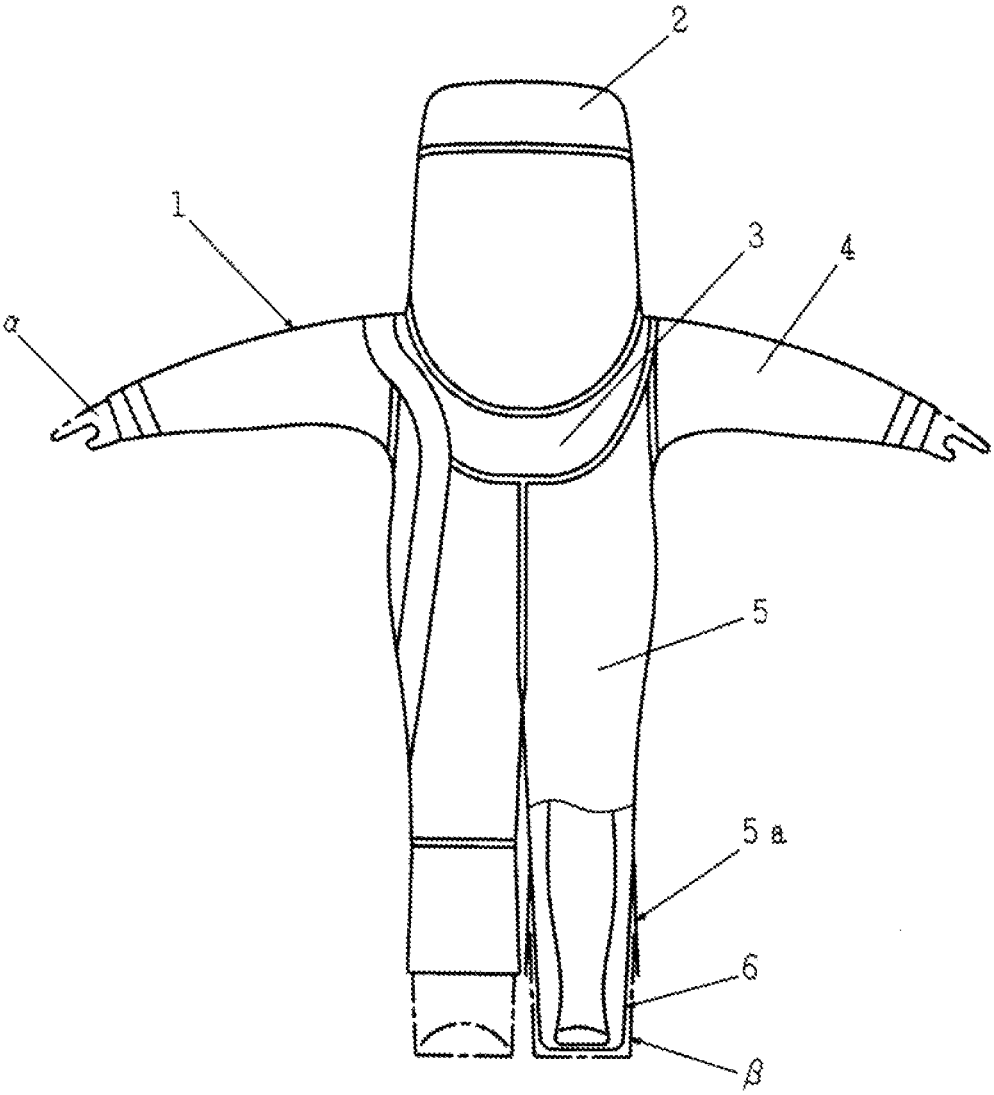
FIG. 1 is a front view of a chemical protective suit in accordance with a preferred embodiment of the present invention.
Figure 2:
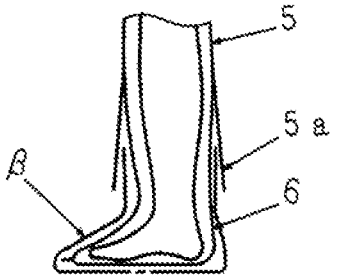
FIG. 2 is a sectional view of the foot portion of a chemical protective suit in accordance with a preferred embodiment of the present invention.

As shown in FIGS. 1 and 2, a chemical protective suit 1 comprises a head portion 2 for covering the part of a human body extending from the top of the head to the neck, a body portion 3 for covering the part of a human body extending from the chest to the abdomen, a pair of arm portions 4 for covering the parts of a human body extending from the shoulders to the wrists, a pair of leg portions 5 for covering the parts of a human body extending from the abdomen to the calves, and a pair of foot portions 6 for covering the parts of a human body extending from the calves to the toes. The aforementioned portions are integrated into a unitary body by integrating a plurality of sheet fabric pieces.

A pair of gloves α for covering the portions of a human body extending from the wrists to the fingers are connected to the chemical protective suit 1 beforehand.

A pair of boots β are fitted on the foot portions as indicated by alternate long and short dash lines in FIGS. 1 and 2 when the chemical protective suit 1 is used.

The leg portions 5 comprise flaps 5*a* for annularly covering the top outer circumferences of the boots β fitted on the foot portions 6.

In the chemical protective suit 1, the leg portions 5 and the foot portions 6 are integrated into a unitary body. Therefore, irrespective of the level of the chemical permeability resistance of the boots β fitted on the foot portions 6, the safety of operations in a working environment with chemical contaminated floors is ensured.

The flaps 5*a* provided on the leg portions 5 prevent chemicals rebounding from the floor, flowing down along the upper portion of the chemical protective suit, or the like from entering into the spaces between the boots β and the foot portions 6.

Figure 3:
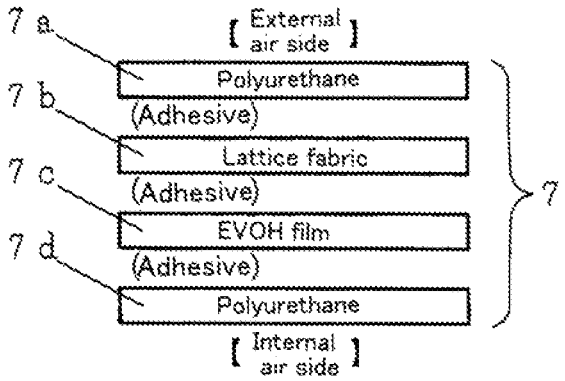
FIG. 3 is a sectional view of a sheet fabric piece forming foot portions of a chemical protective suit in accordance with a preferred embodiment of the present invention.

As shown in FIG. 3, a sheet fabric 7 used in the chemical protective suit 1 has a multi-layer structure comprising a front surface layer 7*a* made of polyurethane resin film to be exposed to the external air when the sheet fabric 7 forms the chemical protective suit 1, a rear surface layer 7*d* made of polyurethane resin film to be exposed to the internal air when the sheet fabric 7 forms the chemical protective suit 1, a lattice fabric middle layer 7*b* disposed between the front surface layer 7*a* and the rear surface layer 7*d* and located close to the front surface layer 7*a*, an EVOH (ethylene vinyl alcohol copolymer) film middle layer 7*c*, which is a chemical permeability resistant resin film, disposed between the front surface layer 7*a* and the rear surface layer 7*d* and located close to the rear surface layer 7*d*, and adhesives disposed between the layers to bond them to one another.

The sheet fabric 7 is cut into a plurality of pieces of predetermined shapes. The plurality of sheet fabric pieces are integrated into a unitary body to form a chemical protective suit 1.

Figure 4:
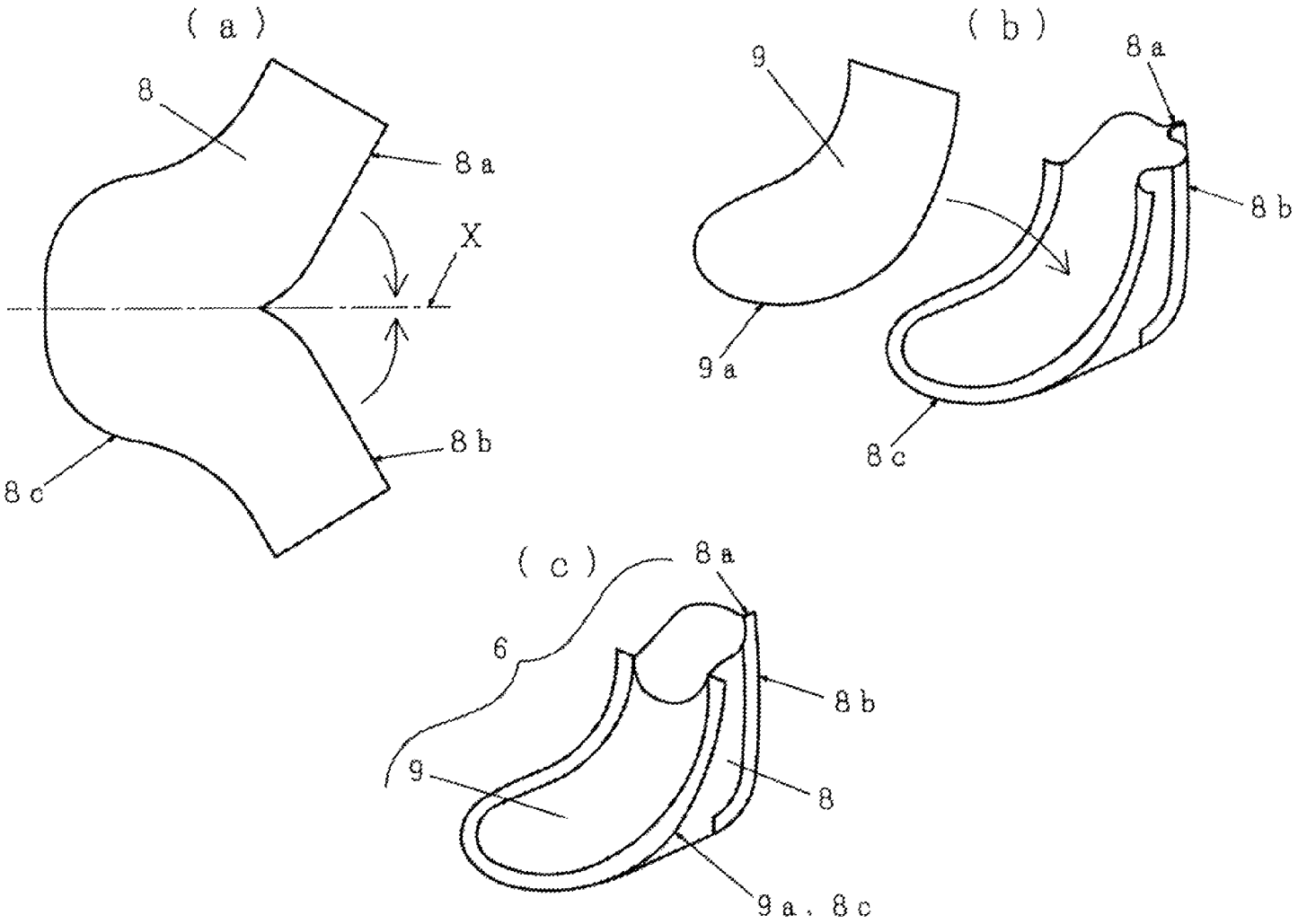
FIG. 4 is a set of views showing the procedure for making the foot portion of a chemical protective suit in accordance with a preferred embodiment of the present invention.

As shown in FIG. 4, the foot portion 6 is produced by integrating a sheet fabric piece 8 for forming a sole and a heel and a sheet fabric piece 9 for forming an instep. At first, the sheet fabric piece 8 is folded along a symmetry axis X as indicated by arrows in FIG. 4(*a*), then portions of the sheet fabric piece 8 close to peripheral edges 8*a* and 8*b* of the heel are stacked on each other, with the peripheral edges 8*a* and 8*b* opposed to each other, and then the portions stacked on each other are integrated as shown in FIG. 4(*b*). Thereafter, a portion of the sheet fabric piece 9 close to a peripheral edge 9*a* of the instep is stacked on a portion of the sheet fabric piece 8 close to a peripheral edge 8*c* of the sole, with the peripheral edge 9*a* and the peripheral edge 8*c* opposed to each other as shown in FIG. 4(*b*), and then the portions stacked on each other are integrated as shown in FIG. 4(*c*). The integrated portions are directed to the outside of the foot portion 6 so as to be exposed to external air.

Figure 5:
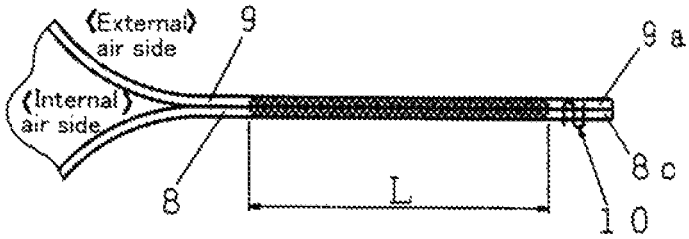
FIG. 5 is a sectional view of the integrated portion of sheet fabric pieces forming the foot portion of a chemical protective suit in accordance with a preferred embodiment of the present invention.

As shown in FIG. 5, the sheet fabric piece 8 is integrated with the sheet fabric piece 9 so as to form the instep by a method comprising the steps of (a) making the peripheral edge 9*a* of the sheet fabric piece 9, whose front surface layer 7*a* is directed upward, oppose the peripheral edge 8*c* of the sheet fabric piece 8, whose front surface layer 7*a* is directed downward, (b) stacking the peripheral portion of the sheet fabric piece 9 including the peripheral edge 9*a* on the peripheral portion of the sheet fabric piece 8 including the peripheral edge 8*c*, (c) seaming the stacked sheet fabric pieces 9 and 8 at a portion close to the peripheral edges 9*a* and 8*c* along the peripheral edges 9*a* and 8*c* so as to make a seam line 10, (d) high frequency dielectric heating the stacked sheet fabric pieces 9 and 8 at a band portion of predetermined breadth L close to the seam line 10 along the seam line 10, with the peripheral edges 9*a* and 8*c* and the band portion disposed to face opposite sides of the seam line 10, thereby welding and integrating the stacked sheet fabric pieces 9 and 8 with each other at the band portion.

The sheet fabric pieces 9 and 8 are welded and integrated with each other at the band portion of predetermined breadth L along the seam line 10 so as to drive out spaces between the stacked sheet fabric pieces 9 and 8 at the band portion of predetermined breadth L. Spaces between the stacked sheet fabric pieces 9 and 8 are driven out at the band portion closer to the internal air than the seam line 10. Thus, air tightness and chemical permeability resistance of the integrated portion between the sheet fabric pieces 9 and 8 are reliably secured.

The portions of the sheet fabric piece 8 for forming the heel are integrated with each other by the same method as aforementioned.

Stacked sheet fabric pieces can be welded and integrated with each other by high frequency dielectric heating because the sheet fabric 7 for forming the foot portion 6 comprises the front surface layer made of thermoplastic polyurethane resin film and the rear surface layer made of thermoplastic polyurethane resin film.

The integrated portion of the two adjacent sheet fabric pieces forming the foot portion 6 does not have a folded portion of the sheet fabric piece. Therefore, the foot portion 6 of the chemical protective suit of the present invention is easier to produce than that of the conventional chemical protective suit.

The integrated portion of the two adjacent sheet fabric pieces forming the foot portion 6 is exposed to the external air and does not project into the internal space of the foot portion 6. Therefore, the foot portion 6 of the chemical protective suit 1 is more comfortable to wear than that of the conventional chemical protective suit, wherein a part of the integrated portion is exposed to the internal air of the foot portion so as to form a projection in the internal space of the foot portion. The boots β are fitted on the foot portions 6. Therefore, the integrated portions of the two adjacent sheet fabric pieces exposed to the external air are concealed from the eyes of others so as not to degrade the appearance of the chemical protective suit 1 worse during use.

The lattice fabric middle layer 7*b* is located closer to the external air than the EVOH film middle layer 7*c*. Thus, the EVOH film middle layer 7*c* is prevented from damage due to external force.

Polyurethane resin film is used for the front surface layer and the rear surface layer of the sheet fabric in the aforementioned preferred embodiment. However, not only polyurethane resin film but also any other type of thermal plastic resin film which can be welded by high frequency dielectric heating can be used for the front surface layer and the rear surface layer of the sheet fabric. Polyvinyl chloride resin film can preferably be used for the front surface layer and the rear surface layer of the sheet fabric.

The breadth L of the welded and integrated band portion is suitably decided for the particular type of resin film used.

INDUSTRIAL APPLICABILITY

The present invention can be widely used for production of a chemical protective suit.

BRIEF DESCRIPTION OF THE REFERENCE NUMERALS

1 Chemical protective suit
2 Head portion
3 Body portion
4 Arm portion
5 Leg portion
6 Foot portion
7 Sheet fabric for use in chemical protective suit
8 Sheet fabric piece for use in sole
9 Sheet fabric piece for use in instep
10 Seam line
α Glove
β Boot

The invention claimed is:

1. A chemical protective suit comprising a head portion for covering the part of a human body extending from the top of the head to the neck, a body portion for covering the part of a human body extending from the chest to the abdomen, a pair of arm portions for covering the parts of a human body extending from the shoulders to the wrists, a pair of leg portions for covering the parts of a human body extending from the abdomen to the calves, and a pair of foot portions for covering the parts of a human body extending from the calves to the toes, wherein the aforementioned portions are integrated into a unitary body, wherein each of the foot portions comprises a first sheet fabric piece forming a sole and a heel and a second sheet fabric piece forming an instep, wherein the first sheet fabric piece and the second sheet fabric piece are adjacent to and integrated with each other, and wherein the integrated portion of each of the adjacent first and second sheet fabric pieces comprises a seam line extending along peripheral edges of the two adjacent first and second sheet fabric pieces stacked on each other, with the peripheral edges opposed to each other, and a welded portion of the stacked first and second sheet fabric pieces of a predetermined breadth extending along the seam line, with the peripheral edges and the welded portion disposed to face opposite sides of the seam line, and wherein the integrated portion of the adjacent first and second sheet fabric pieces in the foot portions is exposed to the external air.

2. A chemical protective suit of claim 1, wherein each of the sheet fabric pieces forming the foot portions is a multi-layer sheet fabric piece comprising a front surface layer of thermoplastic resin film, a rear surface layer of thermoplastic resin film, and at least one middle layer of chemical permeability resistant resin film, and wherein the welded portion is formed using high frequency dielectric heating.

3. A chemical protective suit of claim 2, wherein the thermoplastic resin film forming the front surface layer and the rear surface layer of the sheet fabric piece is polyurethane resin film.

4. A chemical protective suit of claim 2, wherein the thermoplastic resin film forming the front surface layer and the rear surface layer of the sheet fabric piece is polyvinyl chloride resin film.

5. A chemical protective suit of claim 1, wherein each of the sheet fabric pieces forming the foot portions further comprises a middle layer of lattice fabric.

6. A chemical protective suit of claim 1, wherein the leg portions comprise flaps for annularly covering the top outer circumferences of boots fitted on the foot portions.

* * * * *